US009908659B2

(12) United States Patent
Sebille et al.

(10) Patent No.: US 9,908,659 B2
(45) Date of Patent: Mar. 6, 2018

(54) CONTAINER FOR PACKAGING A FIRST AND A SECOND FLUID

(71) Applicant: Cadorit AG, Basel Landschaft (CH)

(72) Inventors: Vincent Sebille, Etampes (FR); Bruno Guillon, Cannes (FR)

(73) Assignee: Cadorit AG, Basel Landschaft (CH)

( * ) Notice: Subject to any disclaimer, the term of this patent is extended or adjusted under 35 U.S.C. 154(b) by 0 days.

(21) Appl. No.: 14/351,518

(22) PCT Filed: Oct. 5, 2012

(86) PCT No.: PCT/EP2012/069805

§ 371 (c)(1),
(2) Date: Apr. 11, 2014

(87) PCT Pub. No.: WO2013/060566

PCT Pub. Date: May 2, 2013

(65) Prior Publication Data

US 2014/0246343 A1 Sep. 4, 2014

(30) Foreign Application Priority Data

Oct. 26, 2011 (FR) ..... 11 59703

(51) Int. Cl.
*B65D 25/08* (2006.01)
*B65D 1/40* (2006.01)
*B65D 81/32* (2006.01)

(52) U.S. Cl.
CPC ..... *B65D 1/40* (2013.01); *B65D 81/3222* (2013.01)

(58) Field of Classification Search
CPC ..... B65D 25/08; B65D 81/3211; B65D 81/3222; B65D 1/40
(Continued)

(56) References Cited

U.S. PATENT DOCUMENTS 2,631,521 A * 3/1953 Atkins, Jr. ..... B65D 51/224 206/222
4,103,772 A * 8/1978 Wiegner ..... 206/222
(Continued)

FOREIGN PATENT DOCUMENTS

DE 2724519 A1 3/1978
EP 1481921 A1 12/2004

OTHER PUBLICATIONS

Derrien, Yannick, "International Search Report," prepared for PCT/EP2012/069805, dated Nov. 30, 2012, 2 pages.

*Primary Examiner* — J. Gregory Pickett
*Assistant Examiner* — Rafael Ortiz
(74) *Attorney, Agent, or Firm* — Winstead PC

(57) ABSTRACT

Container for packaging a first fluid and a second fluid, provided with a rupturable membrane which allows this first fluid to be separated from this second fluid, and with a striker having the function of striking said membrane and thus of allowing the first and the second fluid to mix, wherein the container comprises a first element, suitable for receiving the first fluid with a body comprising a first end provided with a dispenser, and a second end forming an aperture intended for receiving the first fluid, wherein the container also includes a second element, suitable for receiving the second fluid with a body including a first end forming an aperture, intended for receiving the second fluid, and a second end closed by means of a pliable wall, wherein the second element is suitable for being received in the second end of the first element and thus for closing this second end of the first element, and the second element is provided with a striker fixed onto the pliable wall, which thus makes the striker mobile.

7 Claims, 3 Drawing Sheets

Figure 1:
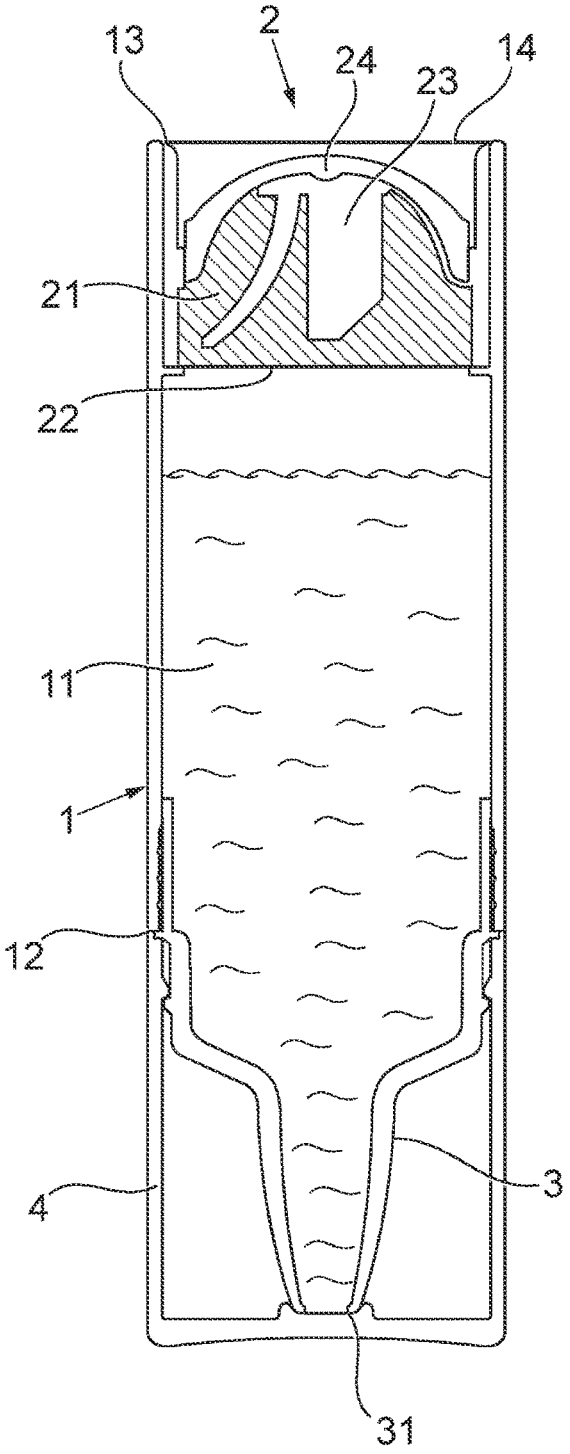

(58) Field of Classification Search
USPC ..... 206/219, 222; 222/80, 145.5, 85; 83/30; 215/DIG. 8, 297; 220/258.4
See application file for complete search history.

(56) References Cited

U.S. PATENT DOCUMENTS

| | | | | |
|---|---|---|---|---|
| 5,391,351 | A * | 2/1995 | Kaufman | A61L 11/00 206/219 |
| 6,003,728 | A * | 12/1999 | Elliott | 222/81 |
| 7,175,049 | B2 * | 2/2007 | Kastenschmidt | B65D 51/226 206/219 |
| 7,900,787 | B2 * | 3/2011 | Oh | B65D 51/28 206/222 |
| 8,820,554 | B2 * | 9/2014 | Rho | B65D 51/224 215/253 |
| 2007/0215496 | A1 | 9/2007 | Scarborough | |
| 2011/0272379 | A1 * | 11/2011 | Eghbaly | 215/6 |

* cited by examiner

CONTAINER FOR PACKAGING A FIRST AND A SECOND FLUID

The present invention relates to a container for packaging a first fluid and a second fluid, provided with a rupturable membrane which allows this first fluid to be separated from this second fluid, and with a striker having the function of striking said membrane and thus of allowing the first and the second fluid to mix.

The container according to the invention comprises a first element, suitable for receiving the first fluid via a body, comprising a first end provided with a dispenser, and a second end which forms a base. This container also includes a second element suitable for receiving the second fluid, said second element being provided with a body which includes a first end forming an aperture intended for receiving the second fluid, and a second end closed by means of a pliable wall.

The invention relates more particularly to the field of packaging suitable for packaging cosmetics products.

The container according to the present invention is suitable for packaging two fluids, such that the two fluids are separated from one another. The first fluid may be, for example, in the form of a liquid, and the second may be a powder. Alternatively, the first and the second products may be, for example, in the form of two liquids. Other combinations of two fluids are also possible.

The prior art discloses several containers which allow a first and a second liquid to be packaged in the same container, whilst ensuring the separation between the first fluid and the second fluid.

These containers are equipped with a striker able to be used at a moment chosen by the user, making it possible to remove the separation between the two fluids, thus permitting the mixture of the two fluids and obtaining a ready-to-use substance.

A container of this type is described in the American patent U.S. Pat. No. 4,103,772. This document describes a container comprising two bodies which each take the form of a container.

A first body includes a first end, provided with a dispenser, and a second end exhibiting an aperture for receiving a first fluid inside the first body. This first body may receive, in its second end, a second body which serves as a closure of this second end of the first body.

For its part, the second body includes a first end forming an intake which makes it possible to receive a second fluid, this end being able to be closed off by a rupturable membrane. The second end of this second body includes a flexible wall provided with a mobile striker in order to be able to displace, at a moment chosen by the user, said striker from a first position referred to as a "rest position" towards a second position which makes it possible to cut the rupturable membrane and permits the mixing of the first fluid, which is contained in the first body, and the second fluid, which is contained in the second body of the container.

In the container according to document U.S. Pat. No. 4,103,772, the second body, its flexible wall and the striker are produced within one sole single step using a moulding process.

The striker according to U.S. Pat. No. 4,103,722 is preferably rigid and, with its acute-angle point shape, ensures optimal opening of the membrane situated between a first and a second fluid.

In order to allow the striker to move from the first position towards the second position, the flexible wall onto which this is fixed is relatively pliable. As indicated above, the second body, its flexible wall and the striker are produced within one single step using one single material. Firstly, this material is chosen in order to ensure the proper packaging of the second fluid inside the second body.

Secondly, the material is chosen to obtain a sufficiently rigid striker and a sufficiently pliable base, the striker, the base and the body of the container all being produced from the same material. A compromise must be found during the container production phase according to U.S. Pat. No. 4,103,772 in order to best respond to the operating imperatives of the different elements of the device.

The aim of the present invention consists in proposing an improvement of the container as described within the American document U.S. Pat. No. 4,103,772. A first objective is to ensure optimal perforation of the membrane situated between the first and the second fluids contained inside the container so that the mixture between the two fluids is perfect.

The object of the invention is a container which allows the packaging of a first fluid and a second fluid, provided with a rupturable membrane which allows this first fluid to be separated from this second fluid, and with a striker having the function of striking said membrane and thus of allowing the first and the second fluid to mix. This container comprises a first element, suitable for receiving the first fluid via a body, comprising a first end provided with a dispenser, and a second end which forms a base. This container also includes a second element suitable for receiving the second fluid, said second element being provided with a body including a first end forming an aperture intended for receiving the second fluid, and a second end closed by means of a pliable wall. This second element, which is suitable for being received in the second end of the first element and thus for closing this second end of the first element, is provided with a striker fixed onto the pliable wall of the second element, which thus makes the striker mobile. The first end of the second element of the container can be closed off by a membrane, in order to make possible the separation between the first fluid, which is received in the first element of the container, and the second fluid, which is received in the second element of the container, said container being characterised in that the striker is an integral part of the body of the second element and is connected to this body by means of at least one arm, wherein the pliable wall is connected to the walls of the body of the second element and to the striker, thus making the striker follow the deformation of the pliable wall.

A first advantage of the container according to the present invention resides in the fact that the striker is substantially composed of the same material as the body of the second element of said container. This means that the material can be chosen to allow optimal perforation of the membrane present between the first and the second fluid.

Conversely, the flexible wall may be produced by means of a material which is specially suitable for tolerating a deformation from a first position towards a second position, and thus permitting the displacement of the striker.

According to a preferred embodiment, the pliable wall is fixed to the second element and to the striker by a chemical adhesion process.

According to a preferred embodiment, the second element and the pliable wall are obtained and fixed by means of an overmoulding process.

In order for the second product to be correctly protected inside the container according to the present invention, it is advisable to ensure that said container, which must be suitable for the specific needs of the product to be packaged, is perfectly sealed. In other words, a perfect contact between the pliable walls and the second element of the container is vital.

According to a preferred embodiment, the striker comprises a central element and at least one pusher.

According to a preferred embodiment, the striker comprises at least a first and a second sector provided with a cut-out towards their ends in order to, together, form a point and wherein the pusher is positioned to be between the first and the second sector of the striker.

According to the invention, during the first use of the device, the user presses on the pliable wall, which brings about the deformation of said pliable wall of said device and the displacement of the striker.

The at least two sectors of the striker, which are cut out at their end to together form a point, allow the membrane to be cut. A pusher is present between two sectors and allows the parts of the membrane cut with the sectors of the striker to be opened completely.

According to an embodiment, the striker has three sectors with three pushers which co-operate with said striker.

According to a preferred embodiment, the striker is connected to the body of the second element by means of three arms which are hemispherical.

According to a preferred embodiment, the second end of the second element is covered by a membrane which forms anti-tamper protection.

According to a preferred embodiment, the second element can be fixed to the second end of the first element by means of a snap-on fixing.

According to a preferred embodiment, following filling with the second fluid, the first end of the second element has been closed off by means of a membrane which takes the form of an aluminium foil.

The invention will become more clearly apparent upon reading the following description which refers to the corresponding figures which are presented for illustrative and non-limiting purposes.

Figure 2:
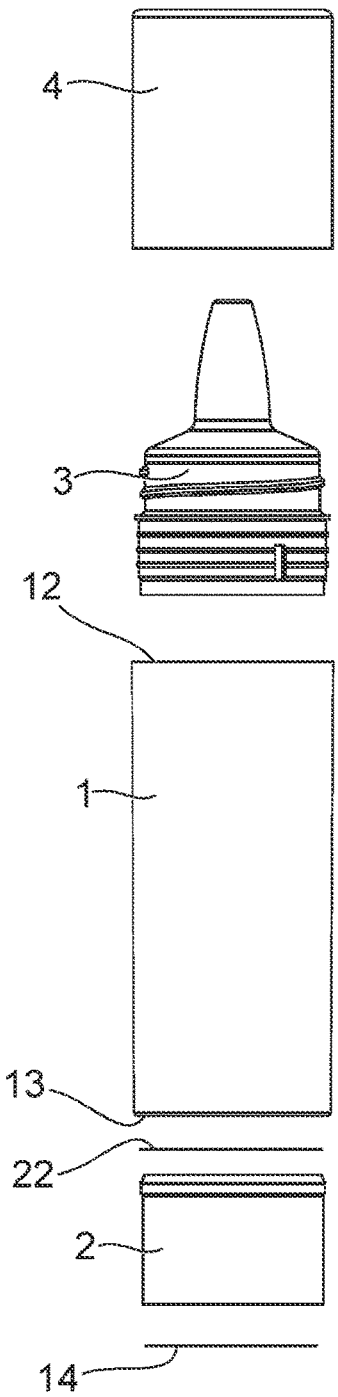
Figure 3:
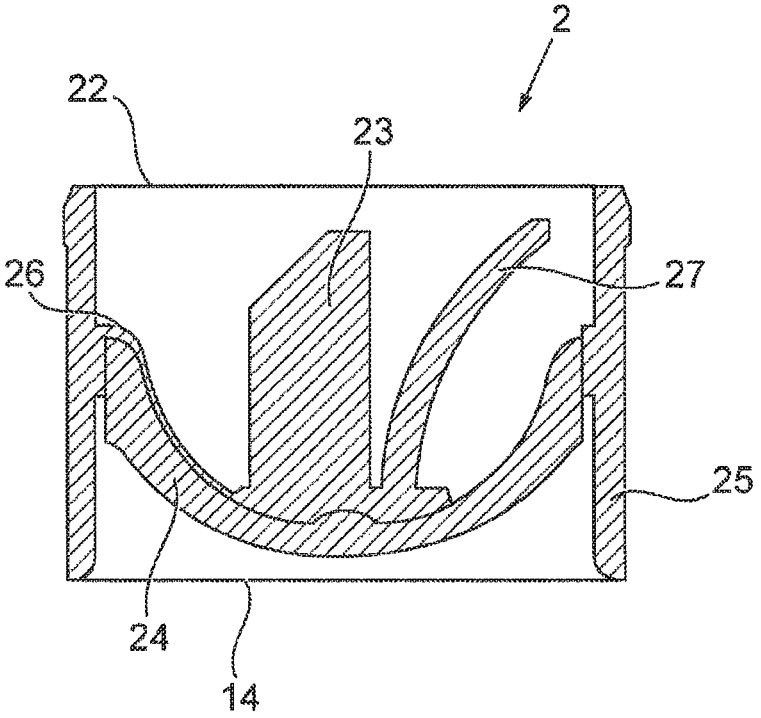
Figure 4:
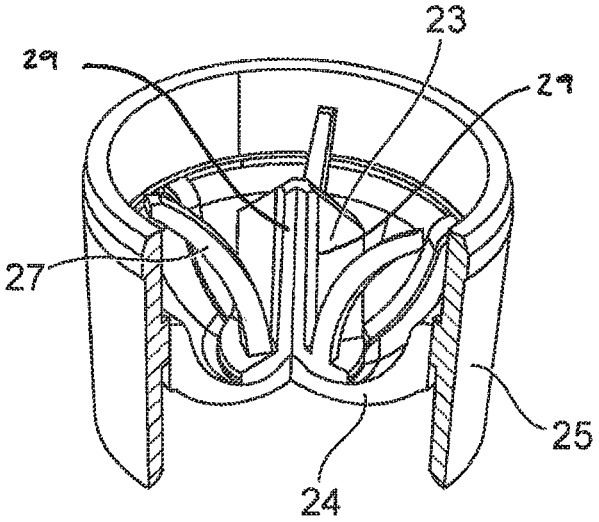
Figure 5:
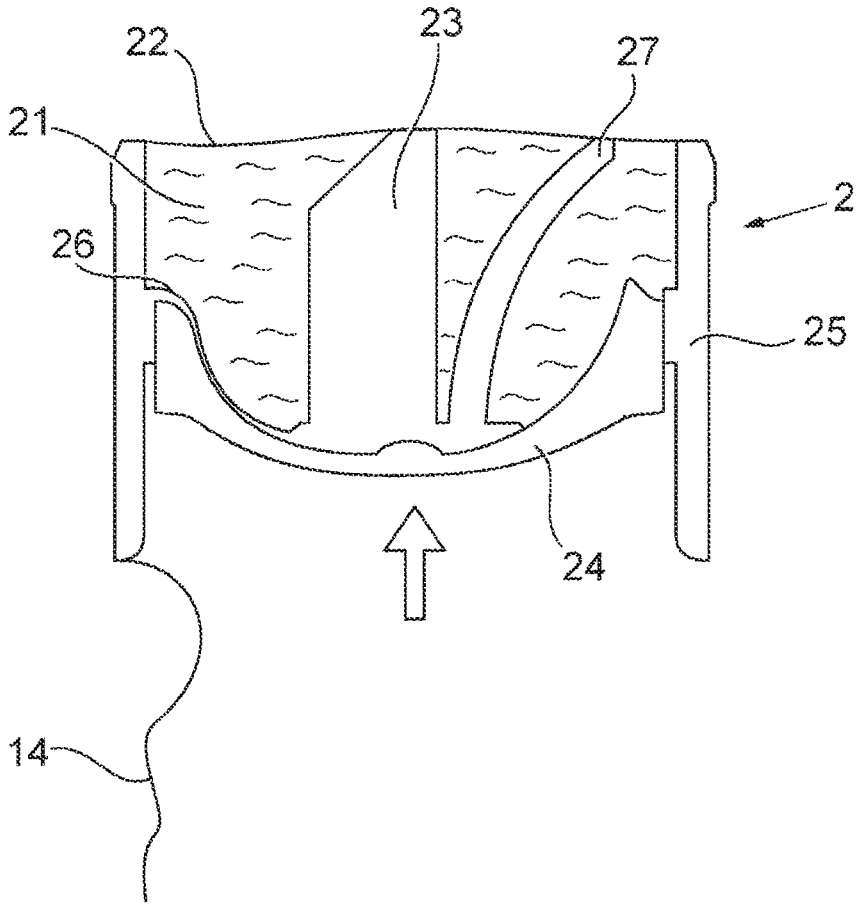

More precisely:

FIG. 1 depicts the container according to the present invention in cross-section, filled with a first and a second fluid, FIG. 2 shows the different elements which make it possible to obtain, after assembly, the container according to the present invention, FIG. 3 depicts, in cross-sectional view, the second element of the container according to the present invention, FIG. 4 shows, partially in cross-section, the second element of the container according to the present invention, in perspective, and FIG. 5 depicts the functionality of the second part of the container according to the present invention.

FIG. 1 depicts the container according to the present invention which includes a first element 1 suitable for containing a first fluid 11, and a second element 2 suitable for containing a second fluid 21.

The first element 1 comprises a body in the form of a first container including a dispenser 3 at its first end 12. This dispenser is provided with an outlet aperture 31 which makes it possible to disperse the fluid towards the outside of the container 10. To close off this outlet aperture 31, before using the container 10, a cap 4 is fixed onto the dispenser 3.

The second end of the element 1 forms, at first, an aperture which allows the element 1 to be filled with a first fluid 11. When the first fluid 11 is received inside the element 1, this second end 13 can be closed off by means of the second element 2.

When the second element 2 is positioned inside the element 1, a membrane 14 can be fixed onto the second end 13 of the element 1, which membrane acts as anti-tamper protection.

The second element 2 of the device 10 has the function of containing a second fluid 21 inside it. In order to prevent the first fluid 11 and the second fluid 21 from mixing before the device 10 is used, these two fluids 11 and 21 are separated by a membrane 22.

At a moment decided by the user, the membrane 22 must be perforated in order to allow the two fluids 11 and 21 to mix. The container 10 according to the present invention is provided with a striker 23 suitable for ensuring the perforation of the membrane 22, said striker 23 being fixed onto a pliable wall 24.

The use of the container 10 according to the present invention is accomplished in the following manner. If a user wishes to use the contents of the container 10 according to the invention, firstly he removes the membrane 14 in order to gain access to the walls 24. The user then uses one finger to exert a pressure onto the wall 24, thus displacing the striker 23 which moves from its first position, as shown in FIG. 1, to the membrane 22. The user can then exert a pressure onto the membrane 22 to ensure that this is perforated, thus allowing the two fluids 11 and 21 to mix. The displacement of the striker is shown in FIG. 5.

The striker 23 is provided with three elements or sectors 29 which are cut out at their ends to form together a single point for cutting out the membrane 22 with the central point which is aided by the three elements of the striker 23. As explained with reference to FIG. 5, the presence of three pushers 27 makes it possible to fully open the various parts of the membrane 22 which have been cut by the striker 23.

After the perforation of the membrane 22, the user shakes the container 10 to ensure that the fluids 11 and 21 are optimally mixed. After this operation, the user can remove the cap 4 and disperse the mixture by means of the aperture 31.

The structure of the element 2 is explained in detail below, with reference to FIGS. 3 and 4.

FIG. 2 refers to the various elements which together form the container 10 according to the invention. The main constructive element is the element 1 depicted with its two ends 12 and 13. The first end 12 can be closed off by means of a dispenser 3, which is itself fixed in the first end 12 of the element 1 by means of projections 32 which make fixing possible by snap-on fixing.

FIG. 2 also shows the cap 4 above the dispenser 3. The second end 13 of the element 1 can be closed off by means of the second element 2.

Firstly, the second element is filled with a fluid 21 (see FIG. 1). The second element 2 is then closed by means of the membrane 22. When the membrane 22 has been fixed onto the element 2, the element 2 and membrane 22 assembly is introduced into the second end 13 of the element 1. Thus, the second end 13 is closed and retains the first fluid (see FIG. 1) inside the element 1.

When the second element 2 is fixed inside the element 1, the membrane 14 can be installed, thus ensuring the anti-tamper protection.

FIG. 3 depicts the second element 2 in greater detail. The second element 2 is shown in cross-section in order to detail the different elements which together form said element 2.

Firstly, the second element 2 is provided with a wall 25. According to the embodiment according to FIG. 3, the wall 25 is substantially cylindrical. The striker 23, which is visible at the centre of this wall 25, is connected to the inside of said wall 25 by means of three arms 26. The three arms 26 situated between the striker 23 and the wall 25 are in the shape of a star.

According to the embodiment according to FIG. 3 and FIG. 4, three arms are used to connect the striker 23 and the wall 25, Of course, a different quantity of arms can be used to keep the striker 23 in the centre of the wall 25.

The arms 26 are particularly important during the production of the assembly made up of the striker 23, the wall 25 and the arms 26. The presence of the arms 26 makes it possible to produce the assembly in a mould in one sole single plastic material injection operation, the same plastic material being used for the wall 25, the striker 23 and the arms 26.

As can be seen in FIG. 3, the arms 26 are of a relatively thin thickness, which means that the arms have a certain flexibility which allows them to follow the movement of the striker 23 towards the wall 24.

The striker is surrounded by three pushers 27. On the cross-sectional view, as shown in FIG. 3, a single pusher is visible. By contrast, the three pushers are clearly depicted and visible on the perspective view, as shown in FIG. 4.

As is shown in FIG. 3, the wall 24 is connected, at its ends, to the wall 25. Furthermore, the wall 24 is connected to the arms 26, to the striker 23 and to the pushers 27. The function of the wall 24 is to move the striker 23 from a first position, as shown in FIG. 3, towards a second position in the direction of the membrane 22 in order to perforate the latter, as depicted in FIG. 5, This is the reason why the wall 24 is produced from a relatively pliable material which allows it to move from its initial position, as shown in FIG. 3, towards its second position, as shown in FIG. 5.

The connection between the wall 24 and the wall 25 of the element 2, the arms 26, the striker 23 and the pushers 27 is produced by means of a chemical adhesion operation. This chemical adhesion is, for example, obtained by producing the element 2 by means of an overmoulding process.

During a first step in the production of the second element, an assembly is produced, by means of a first relatively hard material, made up of the wall 25, the striker 23, the pushers 27 and their connection with the walls in the form of arms 26. The wall 24 is then produced during a second step, by means of this overmoulding process, by means of a relatively pliable material.

FIG. 4 shows the element 2 in perspective, partly in cross-section in order to detail the star shape of the striker 23 and the presence and the position of the three pushers 27 which are situated around the striker 23.

FIG. 5 depicts the second element, in particular the displacement of the wall 24 which allows the striker 23 to be pushed against the membrane 22 and to perforate the latter. The movement performed by the wall 24 is, for example, produced by exerting a pressure against the wall 24 with a finger. The pressure exerted on the walls is symbolically indicated by means of the arrow bearing the reference 50.

FIG. 5 also shows the push exerted by the striker 23 onto the membrane 22, which deforms under the pressure of said striker 23. This deformation of the membrane 22 is moderated until it perforates under the stronger pressure exerted by the striker 23.

As is clearly depicted in FIG. 5, as soon as the striker 23 comes into contact with the membrane 22, the pushers 27 also come into contact with said membrane 22. The pushers 27, which are situated around the striker 23, together ensure an optimal perforation of the surface of the membrane 22. When the perforation of the membrane 22 is effective, the first and the second fluid can mix freely.

Once the user removes the pressure exerted onto the walls 24, the system returns to its initial position whilst leaving the sectors of the perforated membrane 22 open. The three arms 26, aided by their particular shape, return into their initial position bringing along the assembly made up of the striker 23 and the pushers 27.

The invention claimed is:

1. A container comprising:

a rupturable membrane which allows a first fluid to be separated from a second fluid;

a striker, comprising at least one point that perforates the rupturable membrane and thus allowing the first fluid and the second fluid to mix;

a first element, suitable for receiving the first fluid with a body comprising a first end provided with a dispenser, and a second end forming an aperture intended for receiving the first fluid;

a second element constructed of a first material, suitable for receiving the second fluid with a body including a first end forming an aperture, intended for receiving the second fluid, and a second end closed by means of a pliable wall constructed of a second material different from the first material;

wherein the second element is suitable for being received in the second end of the first element and thus for closing this second end of the first element and wherein the second element is provided with the striker fixed on the pliable wall, which makes the striker movable;

wherein the first end of the second element of the container is closed off by the rupturable membrane, which makes possible the separation between the first fluid, which is received in the first element of the container, and the second fluid, which is received in the second element of the container;

wherein the striker is an integral part of the body of the second element and is connected to the body by a plurality of flexible arms;

wherein the pliable wall is connected to the walls of the body of the second element and to the striker, thus making the striker follow deformation of the pliable wall;

wherein the striker comprises a central element and at least one pusher, and at least two sectors which are cut out at their free end towards the rupturable membrane to together form a point to allow the rupturable membrane to be cut;

wherein the pusher is present between the two sectors in proximity to the central element and makes it possible to fully open various parts of the rupturable membrane perforated by the striker; and wherein the striker, the body of the second element, the flexible arms, and the at least one pusher forms an integral element.

2. The container according to claim 1, wherein the pliable wall is fixed to the second element and to the striker by chemical adhesion.

3. The container according to claim 2, wherein the second element and the pliable wall are obtained and fixed by means of an overmoulding process.

4. The container according to claim 1, wherein the striker is connected to the body of the second element by means of three arms having a hemispherical shape.

5. The container according to claim 1 wherein the second end of the second element is covered by a membrane which forms an anti-tamper protection.

6. The container according to claim 1, wherein the second element can be fixed to the second end of the first element.

7. The container according to claim 1, wherein the first end of the second element has been closed off following filling with the second fluid, by means of a membrane which takes the form of an aluminium foil.

* * * * *